US011752799B2

(12) United States Patent
Lee

(10) Patent No.: US 11,752,799 B2
(45) Date of Patent: Sep. 12, 2023

(54) ORNAMENT

(71) Applicant: Che-Yu Lee, Taiwan (CN)

(72) Inventor: Che-Yu Lee, Taiwan (CN)

( * ) Notice: Subject to any disclaimer, the term of this patent is extended or adjusted under 35 U.S.C. 154(b) by 11 days.

(21) Appl. No.: 17/555,551

(22) Filed: Dec. 20, 2021

(65) Prior Publication Data

US 2023/0102070 A1 Mar. 30, 2023

(30) Foreign Application Priority Data

Sep. 24, 2021 (CN) ..... 202122311589.5

(51) Int. Cl.
*A47G 33/08* (2006.01)
*B44F 99/00* (2013.01)

(52) U.S. Cl.
CPC ..... *B44F 99/00* (2013.01); *A47G 33/08* (2013.01)

(58) Field of Classification Search
None
See application file for complete search history.

(56) References Cited

U.S. PATENT DOCUMENTS 9,656,182 B2 5/2017 Kojima
9,839,316 B2 12/2017 Brinegar
10,268,054 B2 4/2019 Lachambre et al.

*Primary Examiner* — Alexander S Thomas

(57) ABSTRACT

The present disclosure relates to the technical field of decorations, in particular to an ornament. The ornament includes a plurality of main bodies. Each main body includes a frame with a regular pentagonal cross section and a regular pentagonal sheet arranged at the bottom of the frame; five sides of the frame are symmetrically provided with connection elements respectively; and the plurality of main bodies are spliced by the adjacent connection elements to form a spherical object. The purpose of the present disclosure is to provide an ornament, which solves the problem that the traditional hollow spherical decorations are easy to collapse during placement.

6 Claims, 3 Drawing Sheets

ORNAMENT

CROSS-REFERENCE TO RELATED APPLICATIONS

This application claims priority to Chinese Patent Application No. 202122311589.5 with a filing date of Sep. 24, 2021. The content of the aforementioned application, including any intervening amendments thereto, is incorporated herein by reference.

TECHNICAL FIELD

The present disclosure relates to the technical field of decorations, in particular to an ornament.

BACKGROUND OF THE PRESENT INVENTION

A spherical decoration or ornament is mainly required to be visually attractive in exterior spherical surface during decorating or placement, while the invisible interior is not important. Therefore, the spherical decoration or ornament usually has a hollow main structure for achieving the demands of reducing manufacturing materials, manufacturing cost and product weight.

The decoration or ornament designed as a hollow sphere certainly meets the requirements of attractive appearance and cost reduction. However, due to the hollow interior, the decoration or ornament will occupy a relatively large space, thereby being difficult for users to store.

SUMMARY OF PRESENT INVENTION

To overcome the shortcomings and deficiencies in the prior art, the purpose of the present disclosure is to provide an ornament, which solves the problems that the traditional hollow spherical decoration is difficult to store and occupy storage space.

The present disclosure is realized by the following technical solution:

An ornament includes a plurality of main bodies; each main body includes a frame with a regular pentagonal cross section and a regular pentagonal sheet arranged at the bottom of the frame; five sides of the frame are symmetrically provided with connection elements respectively; and the plurality of main bodies are spliced by the adjacent connection elements to form a spherical object.

Each connection element includes a first bump and a second bump; a clamping groove is formed between the first bump and the second bump; and the width of the clamping groove is adapted to that of the first bump.

At the same side of the frame, one side of the first bump far away from the second bump is provided with a clamping block; and a clamping hole corresponding to the clamping block is defined in the second bump.

The frame is of a hollow structure; a through hole communicated with a hollow position of the frame is defined in the regular pentagonal sheet; a convex plate is defined on an end face of the regular pentagonal sheet close to the through hole, and is covered with a cover plate.

A pin is arranged on an inner side of the cover plate.

A side face of each regular pentagonal sheet is inclined in a direction toward the frame.

The present disclosure has the beneficial effects that

The problems that the traditional hollow spherical decorations are difficult to store and occupies the storage space are solved; the ornament according to the present disclosure is divided into a plurality of main bodies, and the main bodies can be disassembled by the connection elements, so that the ornament is decorative and storable, and also easy to assemble and rapid to disassemble, thereby achieving the purposes of being easy to store and not occupying the storage space.

DESCRIPTION OF THE DRAWINGS

The present disclosure is further illustrated with the accompanying drawings, but the embodiments in the accompanying drawings do not constitute any limitation to the present disclosure. Those ordinary skilled in the art can obtain other accompanying drawings according to the following accompanying drawings without contributing creative efforts.

Figure 1:
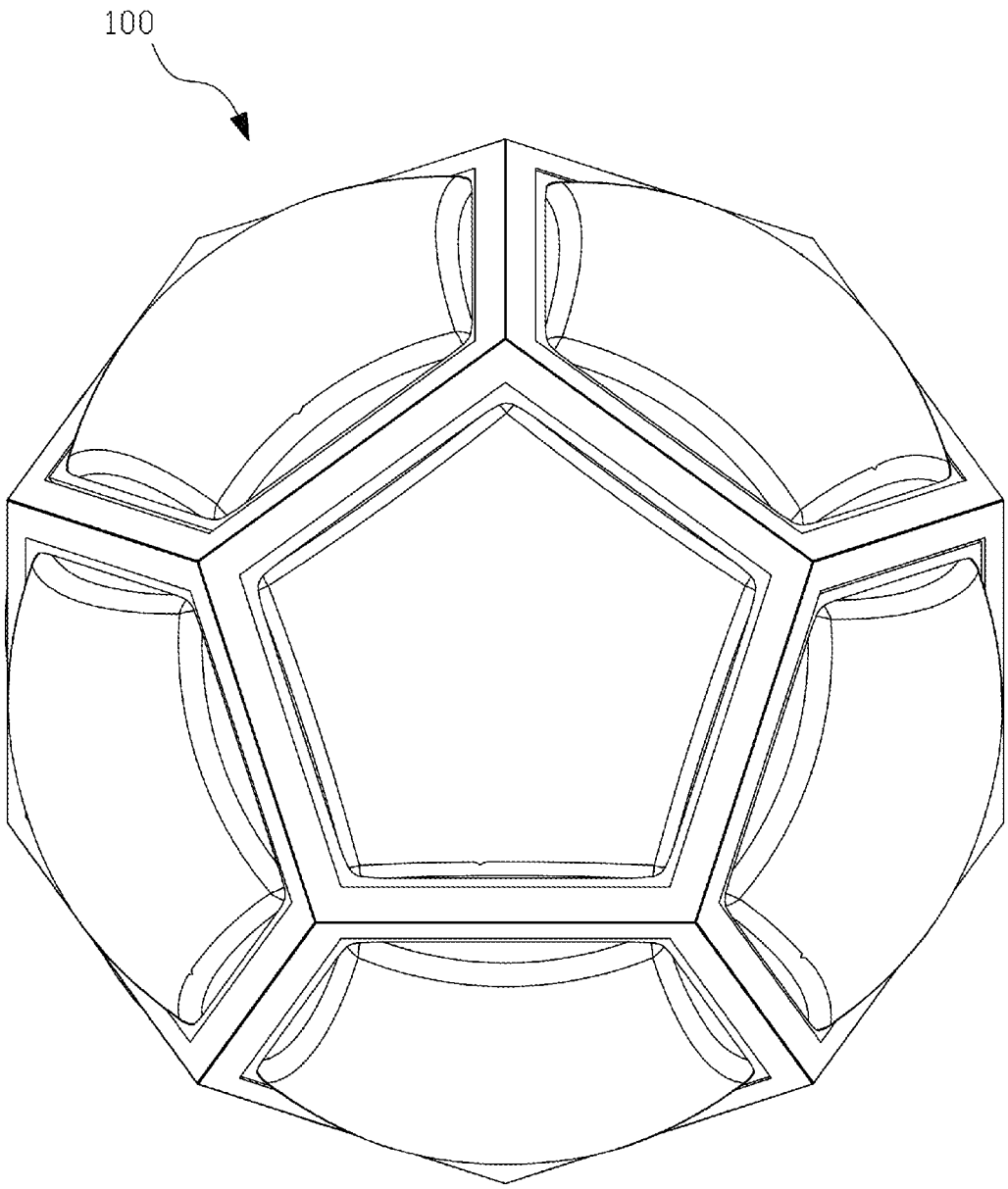
FIG. 1 is a three-dimensional structural schematic diagram of the present disclosure.

REFERENCE NUMERALS main body—100, frame—101, regular pentagonal sheet—102, through hole—103, convex plate—104, cover plate—105, breastpin—106, pin—107, connection element—200, first bump—201, second bump—202, clamping groove—203, clamping block—204, and clamping hole—205.

DETAILED DESCRIPTION OF PREFERRED EMBODIMENTS

To make the above-mentioned purpose, features and advantages of the present disclosure more clear and understandable, specific embodiments of the present disclosure will be described below in detail in combination with the drawings. In the following description, many specific details are elaborated to thoroughly understand the present disclosure. However, the present disclosure can be implemented in other modes different from those described herein. Those skilled in the art can make similar improvement without departing from the connotation of the present disclosure. Therefore, the present disclosure is not limited by specific embodiments disclosed below.

It should be understood in the description of the present disclosure that such as "central", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "circumferential" etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure.

In addition, the terms such as "first" and "second" are only used for the purpose of description, rather than being understood to indicate or imply relative importance or hint the number of indicated technical features. Thus, the features limited by "first" and "second" can explicitly or impliedly comprise at least one feature. In the description of the present disclosure, the meaning of "a plurality of" is at least two, for example, two or three, etc., unless otherwise clearly specified.

Figure 2:
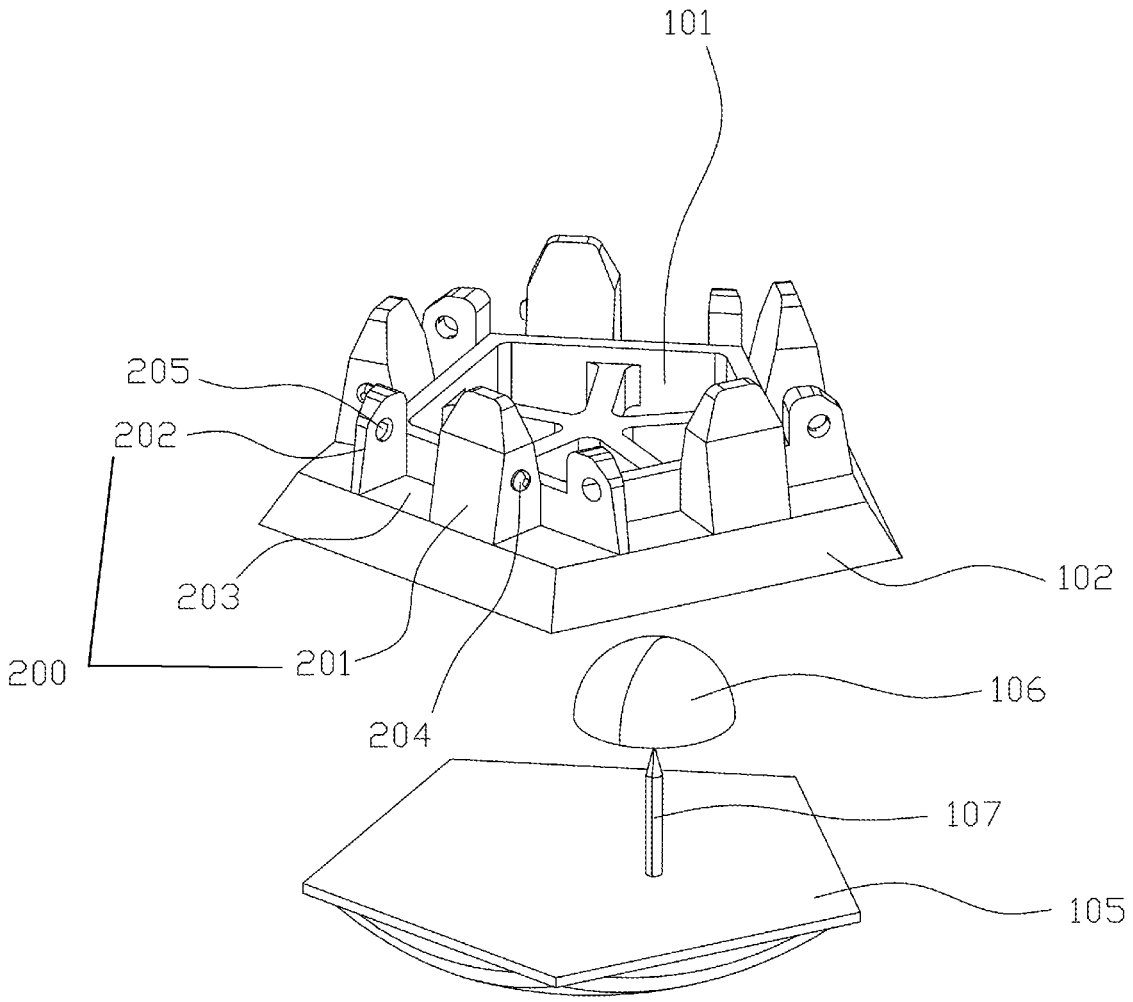
FIG. 2 is an exploded structural schematic diagram of a main body.
Figure 3:
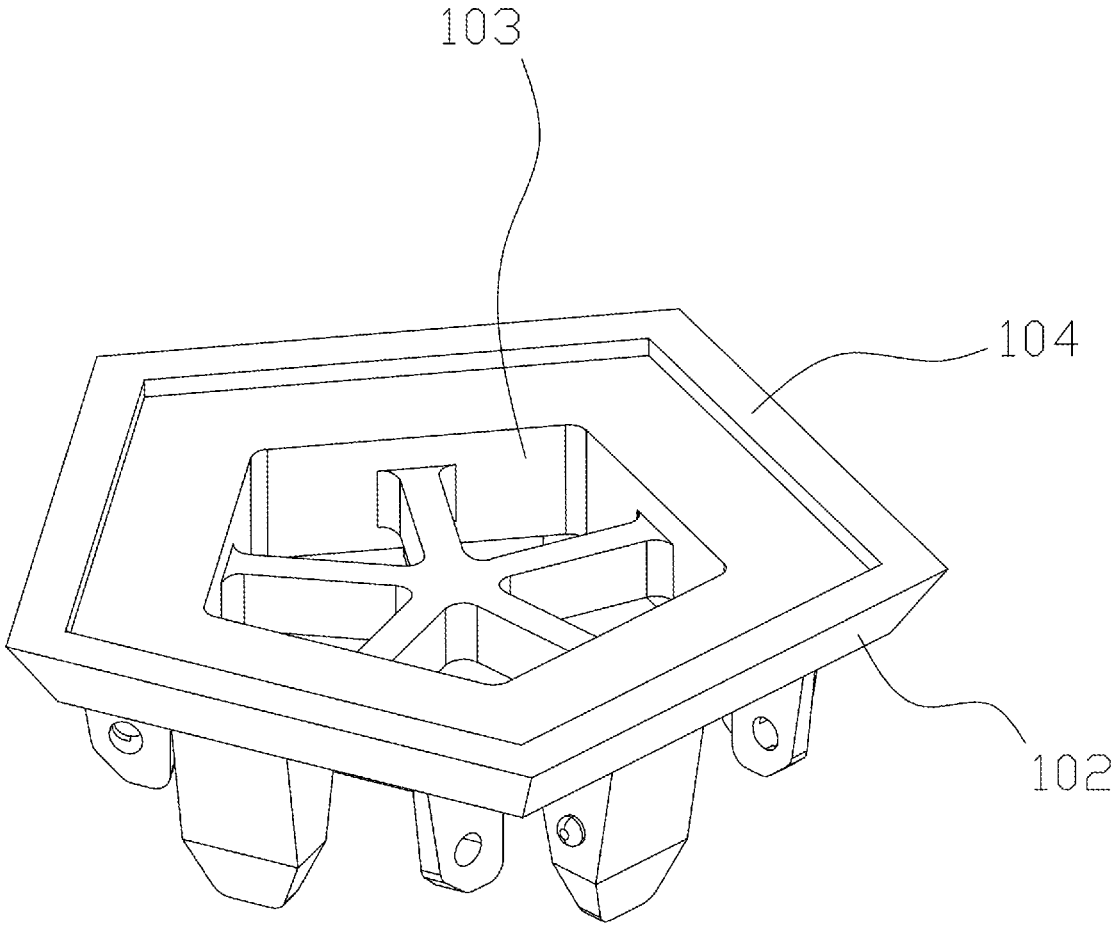
FIG. 3 is another structural schematic diagram of the main body.

As shown in FIGS. 1 and 2, an ornament includes a plurality of main bodies 100; each main body 100 includes a frame 101 with a regular pentagonal cross section and a regular pentagonal sheet 102 arranged at the bottom of the frame 101; five sides of the frame 101 are symmetrically provided with connection elements 200 respectively; and the plurality of main bodies 100 are spliced by the adjacent connection elements 200 to form a spherical object.

Specifically, the ornament according to the present disclosure is divided into a plurality of main bodies 100; and the main bodies 100 can be disassembled through the connection elements 200, so that the ornament is decorative and storable, and also easy to assemble and rapid to disassemble, thereby achieving the purposes of being easy to store and not occupying the storage space.

Specifically, the connection element 200 includes a first bump 201 and a second bump 202; a clamping groove 203 is formed between the first bump 201 and the second bump 202; and the width of the clamping groove 203 is adapted to that of the first bump 201. In practice, in the process of splicing the adjacent main bodies 100, the first bump 201 of one body 100 is inserted into the clamping groove 203 of the adjacent body 100, to complete the splicing. In addition, at the same side of the frame 101, one side of the first bump 201 far away from the second bump 202 is provided with a clamping block 204; a clamping hole 205 corresponding to the clamping block 204 is defined in the second bump 202; and the adjacent main bodies 100 can be stably assembled by the cooperation of the clamping blocks 204 during splicing.

Specifically, the frame 101 is of a hollow structure; a through hole 103 communicated with a hollow position of the frame 101 is defined in the regular pentagonal sheet 102; a convex plate 104 is defined on an end face of the regular pentagonal sheet 102 close to the through hole 103 and is covered with a cover plate 105. In practice, the hollow frame 101 can be used for placing small ornaments such as breastpin 106; and a pin 107 is arranged at the bottom of the cover plate 105 to mount the breastpin 106, which is covered by the cover plate 105 to prevent the articles in the frame 101 from falling. Preferably, the cover plate 105 is attached to the convex plate 104 by a magnet.

Specifically, a side face of each regular pentagonal sheet 102 is inclined in a direction toward the frame 101, so that the adjacent regular pentagonal sheets 102 yield when the adjacent main bodies 100 are assembled, to avoid collision.

Finally, it should be noted that the above embodiments are used for only illustrating the technical solution of the present disclosure, rather than limiting the protection scope of the present disclosure. Although the present disclosure is described in detail with reference to the preferred embodiments, those ordinary skilled in the art should understand that the technical solution of the present disclosure can be modified or substituted equivalently without departing from the essence and scope of the technical solution of the present disclosure.

What is claimed is:

1. An ornament, comprising a plurality of main bodies (100), wherein each main body (100) comprises a frame (101) with a regular pentagonal cross section and a regular pentagonal sheet (102) arranged at a bottom of the frame (101); and five sides of the frame (101) are symmetrically provided with connection elements (200) respectively;

the plurality of main bodies (100) are spliced by the adjacent connection elements (200) to form a spherical object.

2. The ornament according to claim 1, wherein each connection element (200) comprises a first bump (201) and a second bump (202); a clamping groove (203) is formed between the first bump (201) and the second bump (202); and a width of the clamping groove (203) is adapted to a width of the first bump (201).

3. The ornament according to claim 2, wherein one side of the first bump (201) far away from the second bump (202) is provided with a clamping block (204) in each connection element (200), and a clamping hole (205) corresponding to the clamping block (204) is defined in the second bump (202).

4. The ornament according to claim 1, wherein the frame (101) is of a hollow structure; a through hole (103) communicated with a hollow position of the frame (101) is defined in the regular pentagonal sheet (102); a convex plate (104) is defined on an end face of the regular pentagonal sheet (102) close to the through hole (103), and is covered with a cover plate (105).

5. The ornament according to claim 4, wherein a pin (107) is arranged on an inner side of the cover plate (105).

6. The ornament according to claim 1, wherein a side face of each regular pentagonal sheet (102) is inclined in a direction toward the frame (101).

* * * * *